US007303071B2

(12) United States Patent
Saito

(10) Patent No.: US 7,303,071 B2
(45) Date of Patent: Dec. 4, 2007

(54) PACKING CONTAINER FOR ELECTRONIC INSTRUMENT

(75) Inventor: Shinichi Saito, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 331 days.

(21) Appl. No.: 11/078,473

(22) Filed: Mar. 14, 2005

(65) Prior Publication Data

US 2005/0211600 A1 Sep. 29, 2005

(30) Foreign Application Priority Data

Mar. 12, 2004 (JP) ..... 2004-071455

(51) Int. Cl.
*B65D 85/30* (2006.01)

(52) U.S. Cl. ..... 206/320; 206/521; 206/586

(58) Field of Classification Search ..... 206/320, 206/453–454, 521, 586–594
See application file for complete search history.

(56) References Cited

U.S. PATENT DOCUMENTS 4,211,356 A * 7/1980 Tsuchiya et al. ..... 206/586
5,544,806 A * 8/1996 Anderson et al. ..... 206/454
6,685,026 B1 * 2/2004 Hanna ..... 206/586

FOREIGN PATENT DOCUMENTS

| | | |
|---|---|---|
| JP | 49-31732 | 3/1974 |
| JP | 64-9122 U | 1/1989 |
| JP | 06-135461 | 5/1994 |
| JP | 09-104432 | 4/1997 |
| JP | 2561309 | 10/1997 |
| JP | 10-029626 | 2/1998 |
| JP | 2000-318728 A | 11/2000 |

* cited by examiner

*Primary Examiner*—Bryon P. Gehman
(74) *Attorney, Agent, or Firm*—Crowell & Moring LLP

(57) ABSTRACT

In a packing container for an electronic instrument, a pair of tubular shaped bottom cushioning portions is formed by bending a pair of inner bottom flaps several times, and a pair of tubular shaped top cushioning portions is formed by bending a pair of inner top flaps several times. Each of the cushioning portions has a reentrant formed by bending side walls thereof inward to the tubular shape, to which a part of electronic instrument is fitted. The bottom cushioning portions and the top cushioning portions are surface contacted with each other for reinforcing the strength of the container in height direction. Each cushioning portion further has a reinforcing board tightly contacting with the side board for reinforcing the side board.

4 Claims, 4 Drawing Sheets

PACKING CONTAINER FOR ELECTRONIC INSTRUMENT

BACKGROUND OF THE INVENTION

1. Field of the Invention

The present invention relates to a packing container for an electronic instrument to protect it from a shock, and especially relates to a packing container suitable for comparatively thin and lightweight electronic instrument.

2. Description of the Related Art

In a packing container for electronic instrument made of a corrugated fiberboard, cushioning members are used at corners of the packing container for supporting the electronic instrument so as not to be damaged due to a shock, or the like, while the transportation. The cushioning member is generally made of foaming resin such as polystyrene, and has a problem on environment when it is disposed after use.

Therefore, various packing containers are conventionally proposed for solving the above-mentioned problem. For example, Publication of Unexamined Japanese Patent Application No. 9-104432 or 6-135461 shows a packing container in which inside flaps are bent for forming cushioning portions to protect the electronic instrument from a shock. The cushioning members, however, are formed by bending the inside flaps simply, so that the cushioning portions are going to be restored while the electronic instrument is accommodated in the packing container. Thus, it is necessary to steady the cushioning portions by hands so as not to restore. It causes the deterioration of the workability.

In another packing container, for example, shown in Publication of Unexamined Japanese Utility Model Application No. 49-31732, arrow shaped projections are formed on front ends of the cushioning portions so as to be fitted into slits formed on bottom flaps for preventing the restoration of the cushioning portions. There, however, is a problem that the projections are easy to come off from the slits because dimensions of the arrow shaped projections projected from the bottom face of the bottom flaps are small. Even if the dimensions of the arrow shaped projections projected from the bottom face of the bottom flaps are made larger to solve such a problem, the arrow shaped projections projected from the bottom face of the bottom flaps cause the interference when multiple packing containers are piled up. Thus, it becomes difficult to pile up the packing containers in a manner to align the side faces of the piled packing containers, and the piling up of the packing containers becomes unstable.

In still another packing container, for example, shown in Publication of Unexamined. Japanese Patent Application No. 10-29626, fixation projections are formed in circumferences of outer bottom flaps to prevent the restoration of the cushioning portions. Even when the packing container is thin that the height dimension (corresponding to a dimension L shown in FIG. 3) of the inner bottom flap is substantially the same as that of the outer bottom flap, the fixation projections will protrude from the circumferences of the inner bottom flaps and the outer bottom flaps in a developed state before assemble the packing container. Therefore, when several packing containers are mass-produced from one piece of corrugated fiberboard, unavailable odd pieces increase, and it is difficult to reduce the cost of the packing container.

In still another packing container, for example, shown in Registered Japanese Utility Model No. 25661309, an inner side bottom flap is adhered on a pressing piece formed on a bottom flap for increasing reaction force of the pressing piece so as to hold an ingredient firmly. Since the assemble of the packing container needs processes for spreading adhesive on the inner side bottom flap and for crimping the inner side bottom flap and the pressing piece, it is burdensome to assemble the packing container and it is difficult to reduce the cost of the packing container.

Still furthermore, in the above-mentioned conventional packing containers, top cushioning portions and bottom cushioning portions are departed from each other, so that a load applied to the packing container in vertical direction must be supported only by side boards of the packing container. Therefore, if the packing container is dropped due to mistake, the side boards were easy to do buckling, and there was a fear that large stress was applied to the accommodated electronic instrument.

SUMMARY OF THE INVENTION

A purpose of the present invention is to provide a packing container for an electric instrument, in which the electronic instrument can easily be accommodated, and cost of the packing container can be lowered, and the mechanical strength of the packing container can be reinforced.

A packing container for electronic instrument in accordance with an aspect of the present invention comprises: four side boards forming side walls of the packing container; a pair of outer bottom flaps serially formed from lower sides of a pair of first side boards opposing each other among said four side boards and serving as a bottom face of the packing container; a pair of inner bottom flaps serially formed from lower sides of a pair of second side boards opposing each other among said four side boards and bent inside of the outer bottom flaps; a pair of outer top flaps serially formed from upper sides of the first side boards and serving as a top face of the packing container; and a pair of inner top flaps serially formed from upper sides of the second side boards and bent inside of the outer top flaps.

A pair of bottom cushioning portions is formed by bending the inner bottom flaps several times in a manner to have tubular shape and substantially rectangular cross section. A pair of upper cushioning portions is formed by bending the inner top flaps several times in a manner to have tubular shape and substantially rectangular, cross section. Each of the bottom cushioning portions and the top cushioning portions further has a reentrant, to which a part of an electronic instrument is fitted, formed by bending the a part of side wall thereof inward to the tubular shape. Each of the bottom cushioning portions has a lower reinforcing board formed at a portion facing the second side board for reinforcing lower portion of the second side board. Each of the second side board has a hook formed at a position facing the reinforcing board of the bottom cushioning portion and inwardly bent for hooking the bottom cushioning portion in bent state. Each reinforcing board of the bottom cushioning portion has an engaging hole, with which the hook is engaged, at a position corresponding to the hook.

By such a configuration, each of the bottom cushioning portions can be held in bent state owing to engagement of the hook and the engaging hole, so that the electronic instrument can easily be accommodated on the reentrants of the bottom cushioning portions. Furthermore, the lower and upper reinforcing boards reinforce the second side boards, so that the strength of the second side boards can be increased. Still furthermore, the second side boards are coupled with the lower reinforcing boards by the engagement of the hooks and the engaging holes, so that the strength of lower portion of the second side boards is further increased. Still furthermore, since it is no need to provide any protrusion for holding the bottom cushioning portion in the outer periphery portion of the outer bottom flap, it is possible to form a rectangular development of the packing container. When a plurality of packing container is manufactured from a single corrugated fiberboard, it is possible to reduce the emergence of unavailable odd pieces, and to reduce the cost of the packing container.

DETAILED DESCRIPTION OF THE EMBODIMENT

Figure 1A:
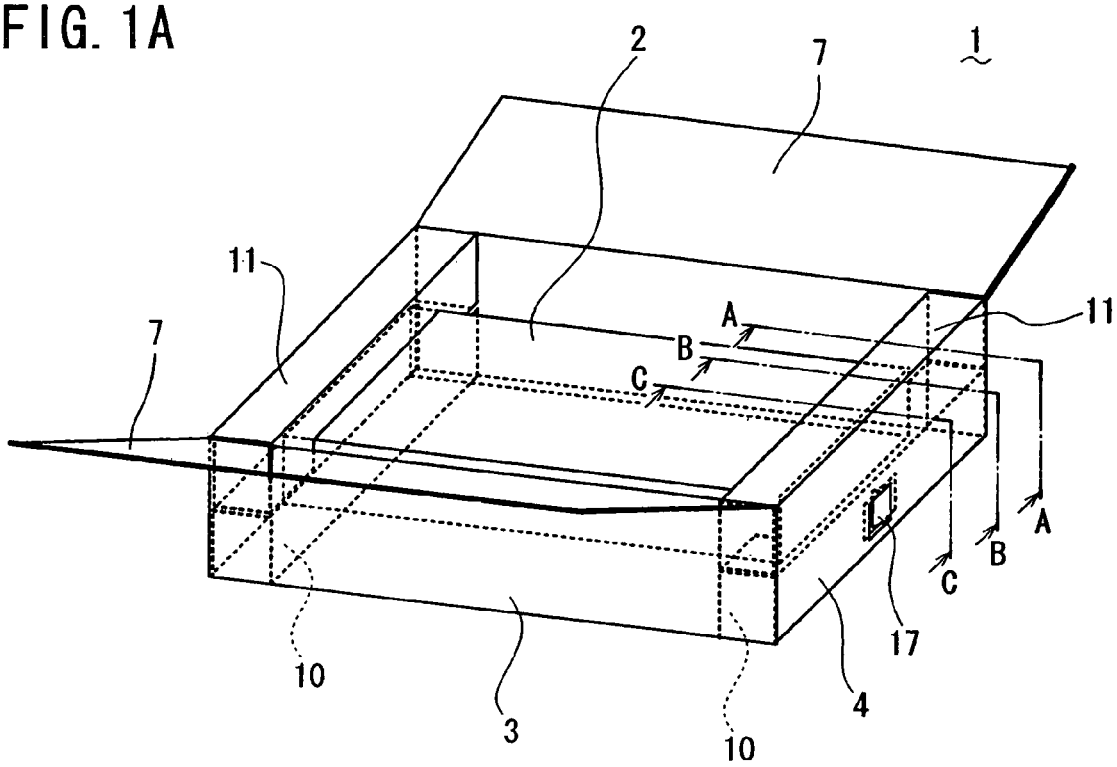
FIG. 1A is a perspective view showing a configuration of a packing container for an electronic instrument in accordance with an embodiment of the present invention.
Figure 1B:
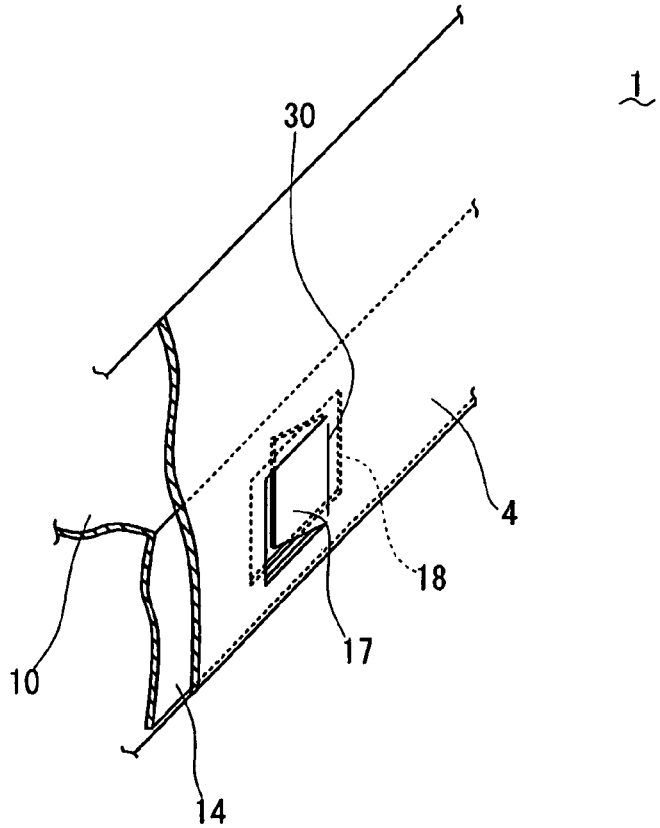
FIG. 1B is a partial perspective view showing a detailed configuration of an enlarged essential portion of FIG. 1A.
Figure 2A:
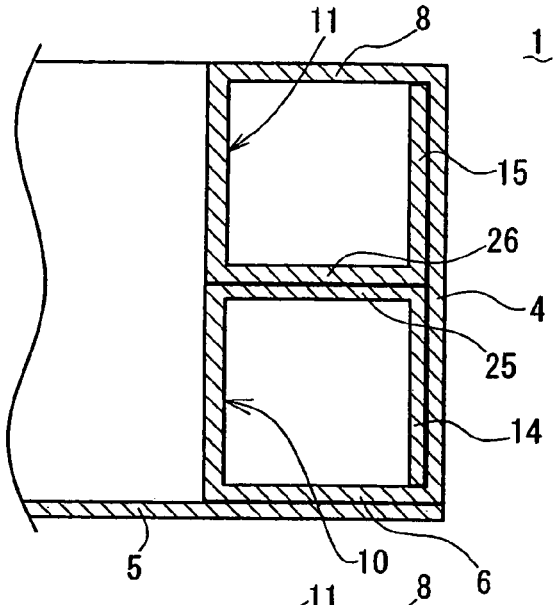
FIG. 2A is an A-A cross sectional view in FIG. 1A.
Figure 2B:
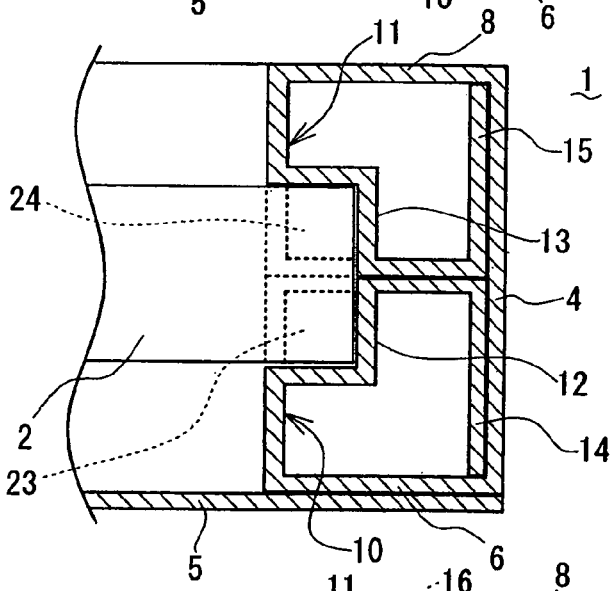
FIG. 2B is a B-B cross sectional view in FIG. 1A.
Figure 2C:
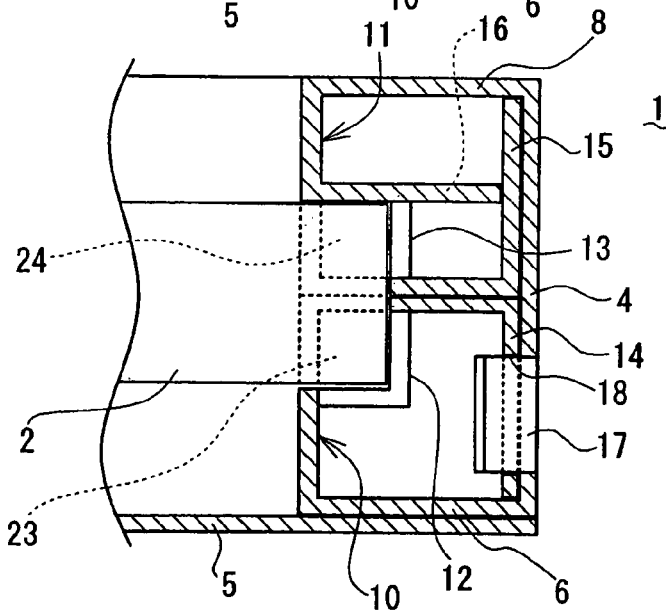
FIG. 2C is a C-C cross sectional view in FIG. 1A.
Figure 3:
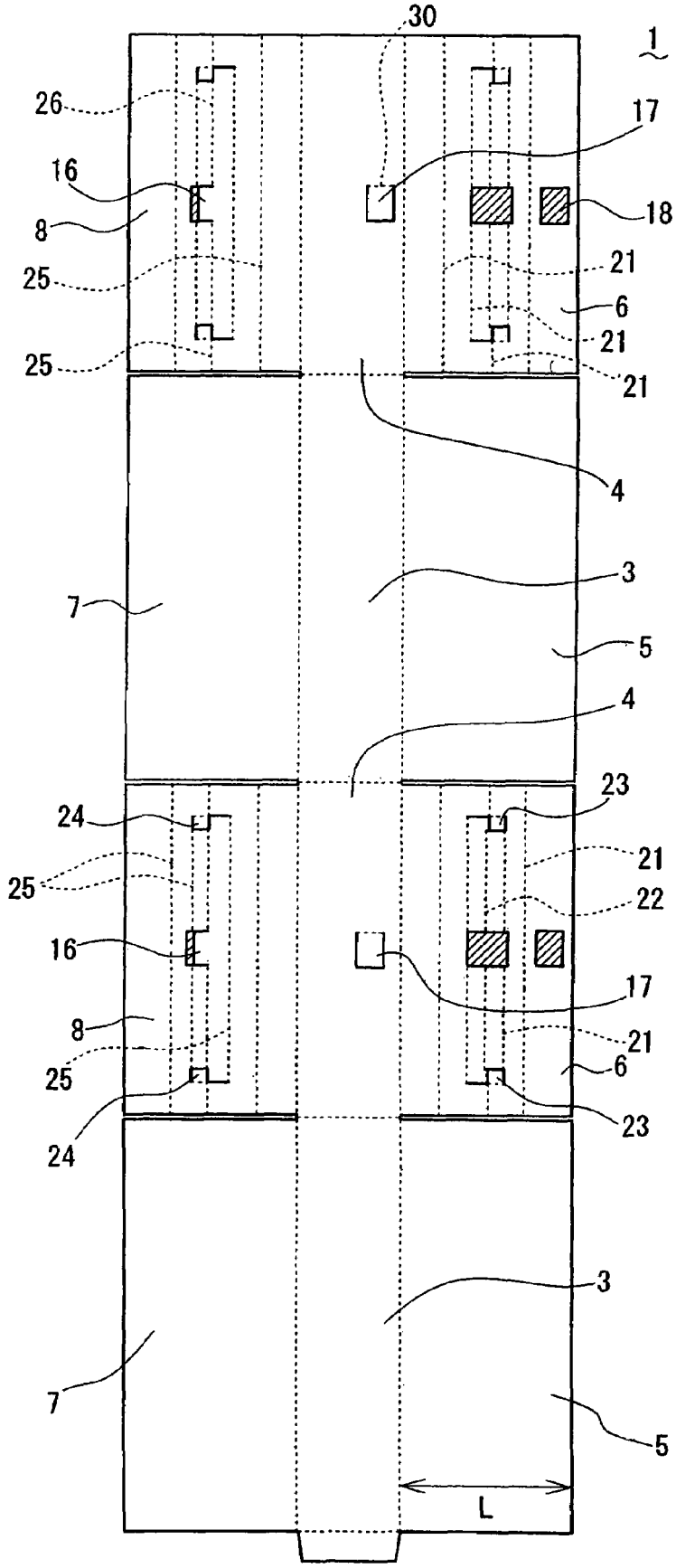
FIG. 3 is a plan view showing a development of the packing container shown in the embodiment.

A packing container for an electronic instrument in accordance with an embodiment of the present invention is described with reference to the figures. FIG. 1A shows appearance of the packing container 1 in the embodiment. FIG. 1B shows an enlarged essential portion of the packing container shown in FIG. 1A. FIGS. 2A to 2C respectively show. A-A, B-B and C-C cross sections in FIG. 1A. FIG. 3 shows a development of the packing container 1 before assembling.

In FIG. 3, solid lines show cutting lines along which a corrugated fiberboard is cut out, and dotted lines show bending lines along which the corrugated fiberboard is bent. Hatched portions show clipped out portions clipped with a cutter.

The packing container 1 is a carton container with which cushioning portions are formed integrally by bending a corrugated fiberboard. The packing container 1 is used for containing a comparatively thin and lightweight electronic instrument 2 such as a DVD (Digital Versatile Disk) player and for protecting it from a shock. The packing container 1 is configured by a pair of longer side boards (first side boards) 3 and a pair of shorter side boards (second side boards) 4 which form four side walls of the packing container 1, a pair of outer bottom flaps 5 serially formed from lower sides of the longer side boards 3 and forming a bottom face of the container, a pair of inner bottom flaps 6 serially formed from lower sides of the shorter side boards 4 and bent inside of the outer bottom flaps 5, a pair of upper top flaps 7 serially formed from upper side of the longer side boards 3 and forming a top face of the container, and a pair of inner top flaps serially formed from upper sides of the shorter side boards 4 and bent inside of the outer top flaps 7.

As shown in FIG. 2A, a bottom cushioning portion 10 of a pipe shape having substantially a square or a rectangular section is formed by bending the inner bottom flap 6 several times from the lower side of the shorter side board 4. Similarly, the top cushioning portion 11 of a pipe shape having substantially a square or a rectangular section is formed by bending the inner top flap 8 several times from the upper side of the shorter side board 4. As shown in FIG. 2B, reentrants 12 and 13, to which the electronic instrument 2 is fitted, are formed at center portions of the top and bottom cushioning portions 10 and 11 by partially bending side faces and top and bottom faces thereof inside.

The bottom cushioning portion 10 has a lower reinforcing board 14 formed by bending a leader of the inner bottom flap 6 for reinforcing a lower portion of the shorter side board 4. The lower reinforcing board 14 tightly contacts with the lower portion of the shorter side board 4 so as to reinforce the lower portion by dispersing a load applied to the shorter side board 4. Similarly, the top cushion portion 11 has an upper reinforcing board 15 formed by bending a leader of the inner top flap 8 for reinforcing an upper portion of the shorter side board 4. The upper reinforcing board 15 tightly contacts with the upper portion of the shorter side board 4 so as to reinforce the upper portion. Consequently, the shorter side board 14 is entirely reinforced by the upper and lower reinforcing boards 14 and 15. The bottom cushioning portion 10 and the top cushioning portion 11 are surface contacted with each other at center boards 25 and 26 at substantially center of the container 1 in a height direction so as to disperse a load applied to the container in the height direction.

As shown in FIG. 2C, the top cushioning portion 11 further has a prop 16 formed to contact with the upper reinforcing board 15 protruded from the same side on which the reentrant 13 is formed. Front end of the prop 16 contacts an inner side face of the upper reinforcing board 15.

Figure 4A:
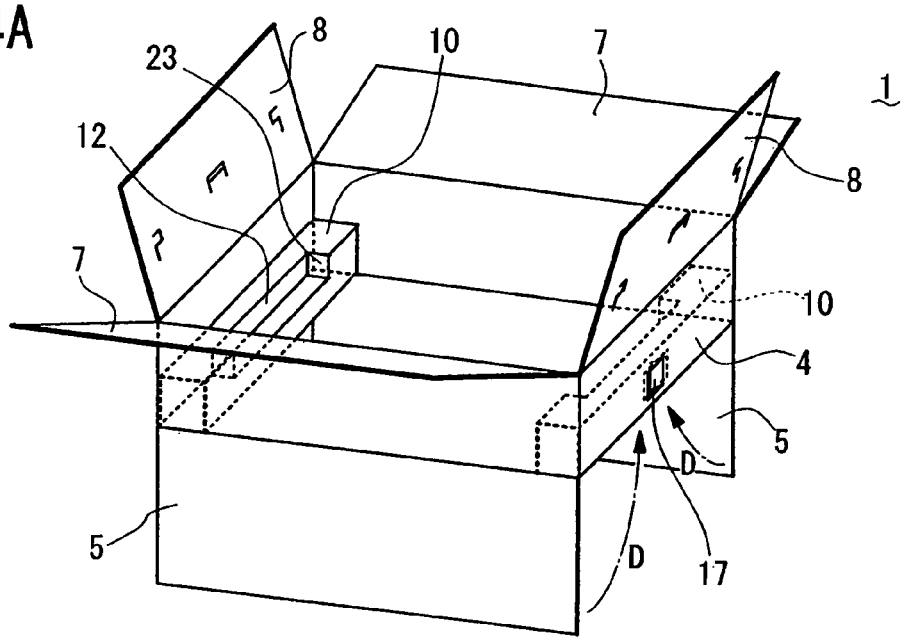
FIG. 4A is a perspective view showing an assemble process of the packing container where bottom cushioning portions are formed in the embodiment.
Figure 4B:
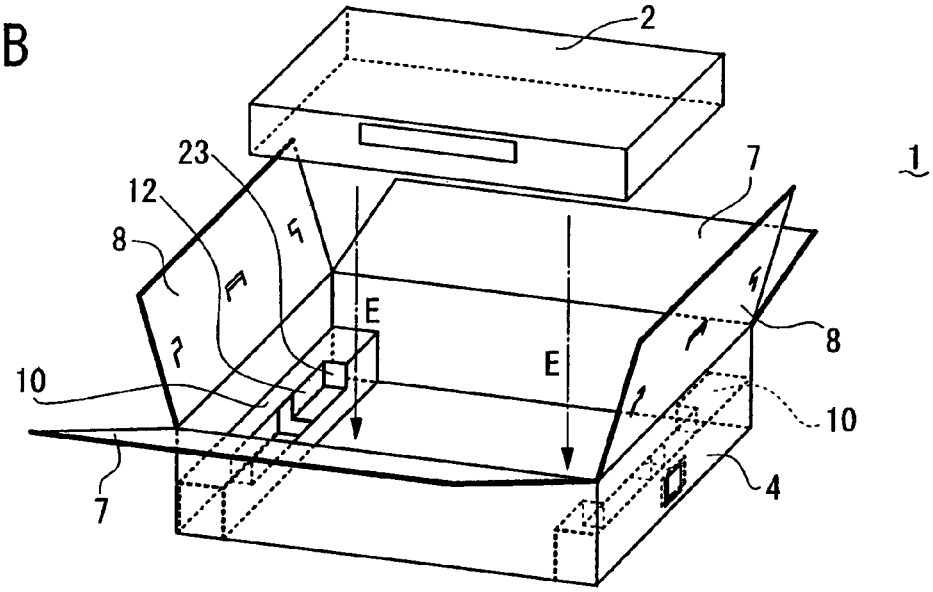
FIG. 4B is a perspective view showing a packing process where an electronic instrument is accommodated into the packing container in the embodiment.
Figure 4C:
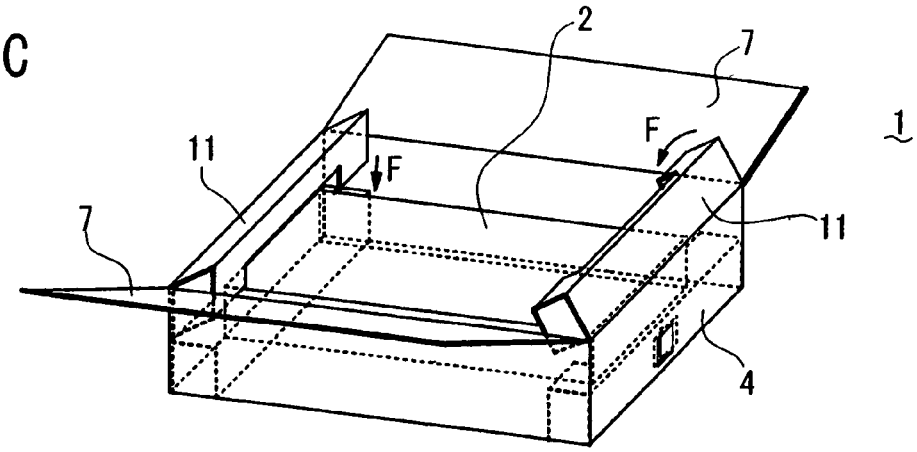
FIG. 4C is a perspective view showing a packing process where top cushioning portions are formed and fitted to the electric instrument in the embodiment.

A hook 17 is formed by bending a position on the shorter side boar 4 facing the lower reinforcing board 14 so as to hook the bottom cushioning portion 10. The hook 17 is formed by cutting the shorter side board 4 as substantially horseshoe shape and bending the horseshoe shaped portion inward along a bending base line 30 as a fulcrum. On the other hand, an engaging hole 18 is formed at a position corresponding to the hook 17 of the lower reinforcement board 14, with which the hook 17 is engaged. As can be seen from FIGS. 1B and 2C, when the hook 17 is engaged with the engaging hole 18, the bottom cushioning portion 10 is maintained in bent state without restoration. As shown in FIGS. 3, 4A and 4B, portions 23 and 24 disposed at both sides of the reentrants 12 and 13 are bent to be substantially parallel to side faces of the electronic instrument 2 so as to serve as side support for contacting with the side faces of the electronic instrument 2. Thus, it is possible to prevent the damage of the electronic instrument 2, even if the packing container 1 with accommodating the electronic instrument 2 were fallen.

Subsequently, packing operation of the electronic instrument 2 contained in the packing container 1 is described with reference to FIGS. 2A to 2C and 4A to 4C. As can be seen from FIG. 4A, the bottom cushioning portions 10 are formed by bending the lower bottom flaps 6 several times along base lines 21 illustrated in FIG. 3. At this time, the lower bottom flaps 6 are bent in the opposite direction along base lines 22 inward to the inside of the square or rectangular section, so that the reentrants 22 are formed.

Subsequently, when the hooks 17 are inwardly bent, the hooks 17 are engaged with the engaging holes 18, so that the bottom cushioning portions 10 are held in bent state. When the outer bottom flaps 5 are bent in directions shown by arrows D and the outer bottom flaps 5 are fixed by a tape or the like, the packing container 1 takes a state that the electronic instrument 2 can be accommodated therein, as shown in FIG. 4B.

When the electronic instrument 2 is accommodated in the packing container 1 in a direction shown by arrow E, the reentrants 12 and the side supports 23 are fitted to the electronic instrument 2 so as to hold or support the electronic instrument 2. Subsequently, the top cushioning portions 11 are formed by bending the inner top flaps 7 several times along base lines 25 and 26. When the top cushioning portions 11 are fitted into gaps between the shorter side boards 4 and the longer side boards 3 and the electronic instrument 2 in directions shown by arrow F, the packing container 1 with the electronic instrument 2 takes a state shown in FIG. 1A. Finally, when the outer top flaps 7 are inwardly bent and fixed by a tape or the like, the packing operation of the electronic instrument 2 is completed.

As mentioned above, in the packing container 1 in accordance with the embodiment, when the hooks 17 are engaged with the engaging holes 18, the bottom cushioning portions 10 are held at bent state in which the lower reinforcing boards 14 are tightly contacted with the lower portions of the shorter side boards 4. Thus, since the bottom cushioning portions 10 are held in bent state without restoration, the accommodation of the electronic instrument 2 can be performed easier. Furthermore, since it is no need to provide any projection for holding the bottom cushioning portion 10 in the outer periphery portion of the outer bottom flap 5, it is possible to form a rectangular development of the packing container 1, as shown in FIG. 3. When a plurality of packing container 1 is manufactured from a single corrugated fiberboard, it is possible to reduce the emergence of unavailable odd pieces, and to lower the cost of the packing container 1.

In addition, since the bottom cushioning portions 10 and the top cushioning portions are surface contacted with each other substantially at the center of the packing container 1 in the height direction, the shorter side boards 4 are reinforced by the lower reinforcing boards 14 and the upper reinforcing boards 15 and the strength of the shorter side boards 4 can be increased. The shorter side boards 4 are further coupled with the lower reinforcing boards 14 by the engagement of the hooks 17 and the engaging holes 18, so that the strength of lower portion of the shorter side boards 4 is further increased much more.

Still furthermore, since the front end of the prop 16 contacts the inner side face of the upper reinforcing board 15, a load applied to the packing container 1 in a direction substantially perpendicular to the shorter side boards 4 can be dispersed. Thus, the strength of the shorter side boards 4 in the direction perpendicular thereto can be increased.

Various kinds of transformation of the present invention are possible without being limited to constitution of the above embodiment. For example, as shown in FIG. 3, it is preferable that the dimension L of the outer bottom flaps 5 is made substantially the same as that of the inner bottom flaps 6 for produce a plurality of the same packing container from a single corrugated fiberboard. It, however, is possible to select the dimensions of the flaps 4 and 5 of the packing container 1 corresponding to sizes and spec of the electronic instrument 2.

Still furthermore, it is possible that the inner bottom flaps 6 and the inner top flaps 8, from which the bottom cushioning portion 10 and the top cushioning portion 11 are formed, are serially formed from the longer side boards 3, and the outer bottom flaps 5 and the outer top flaps 7 are serially formed from the shorter side boards 4.

This application is based on Japanese patent application 2004-71455 filed Mar. 12, 2004 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A packing container for an electronic instrument comprising:

four side boards forming side walls of the packing container;

a pair of outer bottom flaps serially formed from lower sides of a pair of first side boards opposing each other among said four side boards and serving as a bottom face of the packing container;

a pair of inner bottom flaps serially formed from lower sides of a pair of second side boards opposing each other among said four side boards and bent inside of the outer bottom flaps;

a pair of outer top flaps serially formed from upper sides of the first side boards and serving as a top face of the packing container; and a pair of inner top flaps serially formed from upper sides of the second side boards and bent inside of the outer top flaps; wherein a pair of bottom cushioning portions is formed by bending the inner bottom flaps several times so as to produce tubular shapes and substantially rectangular cross sections;

a pair of upper cushioning portions is formed by bending the inner top flaps several times so as to produce tubular shapes and substantially rectangular cross sections;

each of the bottom and top cushioning portions further has a side wall partly bent inward to form a reentrant, to which a part of an electronic instrument is fitted;

each of the bottom cushioning portions has a lower reinforcing board formed at a portion facing one of the second side boards for reinforcing lower portions of the second side boards;

each of the second side boards has a hook, formed at a position facing the reinforcing board of one of the bottom cushioning portions and inwardly bent for hooking the one of the bottom cushioning portions in a bent state; and each of said reinforcing boards has an engaging hole, with which one of the hooks is engaged, at a position corresponding to the one of the hooks.

2. The packing container in accordance with claim 1, wherein each of the upper cushioning portions has an upper reinforcing board formed at a portion facing one of the second side boards for reinforcing upper portions of the second side boards.

3. The packing container in accordance with claim 2, wherein the bottom cushioning portions and the upper cushioning portions contact with each other substantially centrally of the packing container heightwise for reinforcing the second side boards from the lower side to the upper side thereof.

4. The packing container in accordance with claim 3, wherein each of the upper cushioning portions further has a prop formed to protrude from a side on which its reentrant is formed in a manner so that a front end thereof contacts with one of the upper reinforcing boards.

* * * * *